US005899094A

United States Patent [19]

Ikoma

[11] Patent Number: 5,899,094

[45] Date of Patent: May 4, 1999

[54] FLAT KNITTING MACHINE COMPRISING A SET-UP DEVICE

[75] Inventor: Kenji Ikoma, Wakayama, Japan

[73] Assignee: Shima Seiki Manufacturing, Ltd., Wakayama, Japan

[21] Appl. No.: 08/975,895

[22] Filed: Nov. 5, 1997

[30] Foreign Application Priority Data

Nov. 6, 1996 [JP] Japan ..... 8-294113

[51] Int. Cl.[6] ..... D04B 15/88

[52] U.S. Cl. ..... 66/149 R

[58] Field of Search ..... 66/147, 148, 149 R, 66/150, 152

[56] References Cited

U.S. PATENT DOCUMENTS

| | | | |
|---|---|---|---|
| 3,375,683 | 4/1968 | Joseph | 66/149 R |
| 3,618,343 | 11/1971 | Essig | 66/149 R |
| 5,040,384 | 8/1991 | Shima . | |
| 5,097,684 | 3/1992 | Shima . | |
| 5,241,841 | 9/1993 | Schmid et al. | 66/149 R |

FOREIGN PATENT DOCUMENTS

| | | |
|---|---|---|
| 62-26472 | 7/1987 | Japan . |
| 6-60443 | 8/1994 | Japan . |

*Primary Examiner*—John J. Calvert
*Assistant Examiner*—Larry D. Worrell, Jr.
*Attorney, Agent, or Firm*—Longacre & White

[57] ABSTRACT

A flat knitting machine comprising: at least a pair of front and rear needle beds defining a gap therebetween; and a set-up device disposed below said gap, said set-up device including: a plurality of setting-up needles, each having a setting-up needle base member and a setting-up needle slider member, the setting-up needle slider member being movable relative to the setting-up needle base member to selectively hold and release a set-up portion of a knitted fabric; a setting-up needle bed supporting the plurality of setting-up needles so that the plurality of setting-up needles are juxtaposed to one another and that each of the setting-up needles is movable in both a fabric pull-down direction and a direction opposite thereto; first biasing means for biasing each of the setting-up needles in the fabric pull-down direction relative to the setting-up needle bed; and setting-up needle hold and release means for moving the setting-up needle slider member relative to the setting-up needle base member to thereby control the setting-up needle slider member to hold and release the set-up portion of said knitted fabric.

12 Claims, 11 Drawing Sheets

9
7B
39
7A
37A
29A
27A
31
37B
29B
27B
21
99
97
95
61
17A
110A
111
103
109C
105A
109A
110B
119
113
15
109B
109D
117
115
35
25
33

FLAT KNITTING MACHINE COMPRISING A SET-UP DEVICE

FIELD OF THE INVENTION

The present invention relates to a set-up device for use in a flat knitting machine which includes at least a pair of front and rear needle beds disposed opposed to each other and, in particular, to a set-up device for use in a flat knitting machine which is suitable to knit a fabric in which the number of knitted courses is varies from wale to wale.

BACKGROUND OF THE INVENTION

Conventionally, in a flat knitting machine, there is provided a set-up device which is disposed below a gap between a pair of front and rear needle beds. The set-up device pulls down a knitting yarn supplied as the set-up portion of a fabric being knitted to thereby apply a tension to the completely knitted fabric and thus prevent stitches retained to knitting needles from moving apart from the knitting needles, so that the set-up device can pull down the knitted fabric until the knitted fabric is held by a roller type of wind-down device. As the above-described set-up device, the present applicant discloses a slider opening/closing type of set-up device in U.S. Pat. Nos. 5,097,684 and 5,040,384.

In a set-up device used in an ordinary flat knitting machine, setting-up needles juxtaposed side by side in a setting-up needle bed are all pulled down while they are held at the same height. Therefore, such a set-up device is suitable to knit a fabric in which the number of knitted courses is uniform in every wales. However, when knitting a fabric in which the number of knitted courses varies from wale to wale, the set-up device is not able to apply an appropriate pull-down tension to the respective wales. In view of this, when knitting a fabric in which the number of knitted courses varies from wale to wale, (in order that the pull-down tension can be made as uniform as possible in order that the respective portions of the fabric be knitted in parallel according to a ratio between the numbers of knitted courses), it is necessary to create the knitting data with the numbers of the knitted courses of the respective portions taken into consideration. However, merely adjusting the numbers of knitted courses is not sufficient to attain the above object. Therefore, in Japanese Patent Publication No. 6-60443, there is disclosed a method in which a collar portion referred to as a wing collar is knitted by flechage following a sacrificially knitted portion to thereby enable to knit a fabric for a collar in which the number of knitted courses varies from wale to wale. However, when the fabric for a collar is knitted following the sacrificial knitting in this manner, the knitting yarn is consumed wastefully for the sacrificial knitting.

As a preceding invention relating to a set-up device made by the present applicant, there exists Japanese Utility Model Publication No. 62-26472. In the device disclosed in this publication, there is mounted a spring which is used to bias individual setting-up needles in their pull-down direction. In the set-up device, a knitted fabric is released from the setting-up needles by a fabric release plate which pushes out the knitted fabric in a direction where the knitted fabric can be removed from the hooks of the setting-up needles. However, with use of this method in which the knitted fabric is released by the fabric release plate, if the knitted fabric is one having the number of knitted courses varies from wale to wale, the distance between the portion of the knitted fabric to be contacted by the fabric release plate and the set-up portion of the knitted fabric varies from wale to wale.

Thus, this causes the case a problem that the knitted fabric is hard to be released from the setting-up needles in the areas having a large number of knitted courses. Also, a space, which exists below a gap between the front and rear needle beds and in which the fabric release plate is disposed, is limited. Therefore, the fabric release plate is disposed at a position further lower than just below the gap. And, in the case of the knitted fabric such as the wing collar disclosed in the above-cited Japanese Patent Publication No. 6-60443, the number of knitted courses in the knitted fabric is small. Accordingly, in most cases, the fabric is not knitted so long as to be released by the above-described fabric release plate. In this case, of course, the knitted fabric cannot be released by the fabric release plate.

As described above, according to the method in which the knitted fabric is released by the fabric release plate, the knitted fabric can be released only when the distance between the setting-up needles and fabric release plate is a certain long distance. However, in other distances, there is a possibility that the knitted fabric cannot be released from the setting-up needles. Therefore, in the set-up device disclosed in the above-described Japanese Utility Model Publication No. 62-26472, it is difficult to knit a fabric in which the number of knitted courses varies greatly from wale to wale. Also, in a flat knitting machine using the slider opening/closing type of setting needles disclosed in the above-described U.S. Pat. Nos. 5,097,684 and 5,040,384, there is disclosed a mechanism in which there is formed a position controlling butt in the slider or in the setting-up needle body, and a cam is engaged with or removed from the butt to thereby control the appearance or retreat of the hook of the setting-up needles, so that holding and release of the knitted fabric can be controlled regardless of the fabric to be knitted. However, in this publication, there is no disclosure relating to a method for holding and releasing the knitted fabric when the individual setting-up needles are so formed as to be independently movable. The set-up device of the present invention aims at-solving the above-described problems in the conventional set-up devices.

SUMMARY OF THE INVENTION

Accordingly, it is an object of the present invention to provide a set-up device for use in a flat knitting machine which applies an appropriate pull-down tension according to the number of knitted courses of the respective wales of the knitted fabric, when knitting a fabric having a different number of knitted courses from wale to wale, and which is also surely capable of holding and releasing a knitted fabric even in the case that the number of knitted courses is small as in a collar portion and the setting-up needles are individually moved to different positions.

Other objects and effects of the present invention will be apparent from the following description.

The above described objects of the present invention have been achieved by providing:

a flat knitting machine comprising:

at least a pair of front and rear needle beds defining a gap therebetween; and a set-up device disposed below said gap, said set-up device including:

a plurality of setting-up needles, each having a setting-up needle base member and a setting-up needle slider member, said setting-up needle slider member being movable relative to said setting-up needle base member to selectively hold and release a set-up portion of a knitted fabric;

a setting-up needle bed supporting said plurality of setting-up needles so that said plurality of setting-up needles are juxtaposed to one another and that each of said setting-up needles is movable in both a fabric pull-down direction and a direction opposite thereto;

first biasing means for biasing each of said setting-up needles in said fabric pull-down direction relative to said setting-up needle bed; and setting-up needle hold and release means for moving said setting-up needle slider member relative to said setting-up needle base member to thereby control said setting-up needle slider member to hold and release said setup portion of said knitted fabric. By employing the above-described constitution, the individual setting-up needles can apply an appropriate pull-down tension to the respective wales of the knitted fabric according to the number of knitted courses by the biasing force of the biasing means which biases the setting-up needles in the fabric pull-down direction. Further, after the knitting of the fabric is completed, a movable setting-up needle member is moved by the setting-up needle hold and release means situated at different positions in the fabric pull-down direction due to the differences between the numbers of knitted courses, so that the knitted fabric can be released from the setting-up needles.

The setting-up needle hold and release means for use in the present invention preferably includes second biasing means for biasing the setting-up needle slider member in a direction to permit the setting-up needles to hold the set-up portion of the knitted fabric, and releasing means for moving the setting-up needle slider member against the biasing force of the biasing means in a direction to release the set-up portion of the knitted fabric from the setting-up needles. According to this constitution, the releasing of the knitted fabric from the setting-up needles is effected by moving the setting-up needle slider member against the biasing force of the biasing means by the action of the releasing means.

Preferably, the setting-up needle slider member has a hook-shaped yarn retaining portion and the setting-up needle base member has a storage portion for covering, when viewed from the side surface thereof, the hook-shaped yarn retaining portion of the setting-up needle slider member. According to this constitution, the knitting yarn is retained in a condition that the hook-shaped yarn retaining portion of the setting-up needle slider member is projected, if viewed from the side surface thereof, from the storage portion of the setting-up needle base member, and the knitting yarn is released by retracting, if viewed from the side surface thereof, the hook-shaped yarn-retaining portion into the storage portion.

The first biasing means for biasing the respective setting-up needles in the fabric pull-down direction relative to the setting-up needle bed preferably functions also as second biasing means for biasing said setting-up needle slider member in a direction to permit said setting-up needle to hold said set-up portion of said knitted fabric. By employing this constitution, the set-up device can be simplified.

In addition, each of the setting-up needles preferably has a spacer which is provided on one side thereof and which has such a thickness as to contact with its adjacent setting-up needle, whereby the setting-up needles are held without being deflected.

BRIEF DESCRIPTION OF THE DRAWINGS

FIG. 6A is a side view of the setting-up needle, showing a state thereof in which it is closed; FIG. 6B is a side view of the setting-up needle, showing a state thereof in which it is open; and FIG. 6C is a front view thereof corresponding to FIG. 6B;

FIG. 7A is a section view thereof corresponding to FIG. 6A; and FIG. 7B is a section view thereof corresponding to FIG. 6B;

FIGS. 10-1 to 10-8 each is a typical view of the movements of yarn feed ports when a set-up knitting operation is carried out.

DESCRIPTION OF THE-PREFERRED EMBODIMENT

Preferred embodiments of a set-up device and of a flat knitting machine comprising a set-up device is explained in detail below with reference to the accompanying drawings.

Figure 1:
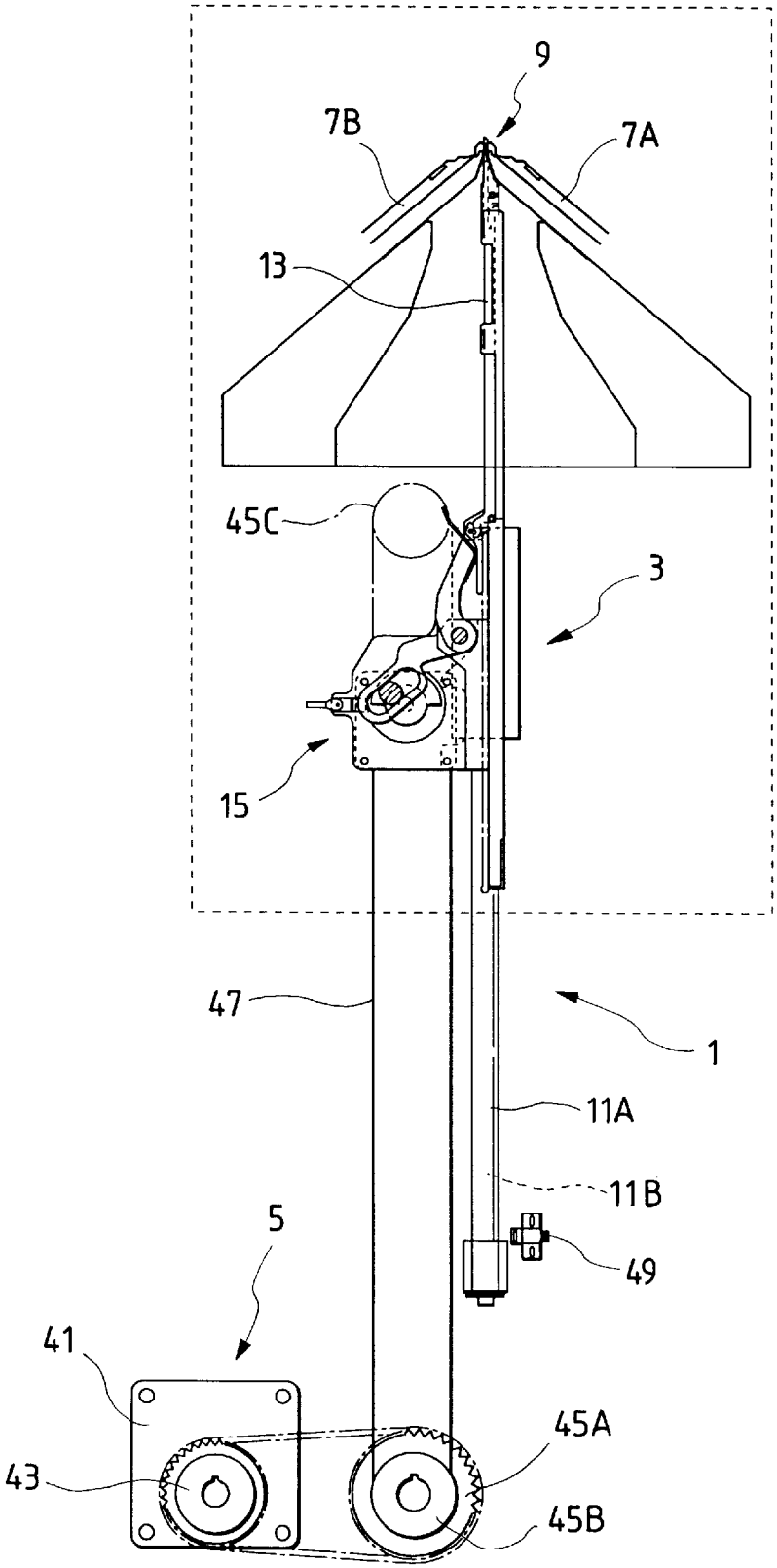
FIG. 1 is a side view of a schematic structure of a flat knitting machine comprising a set-up device according to the invention.
Figure 2:
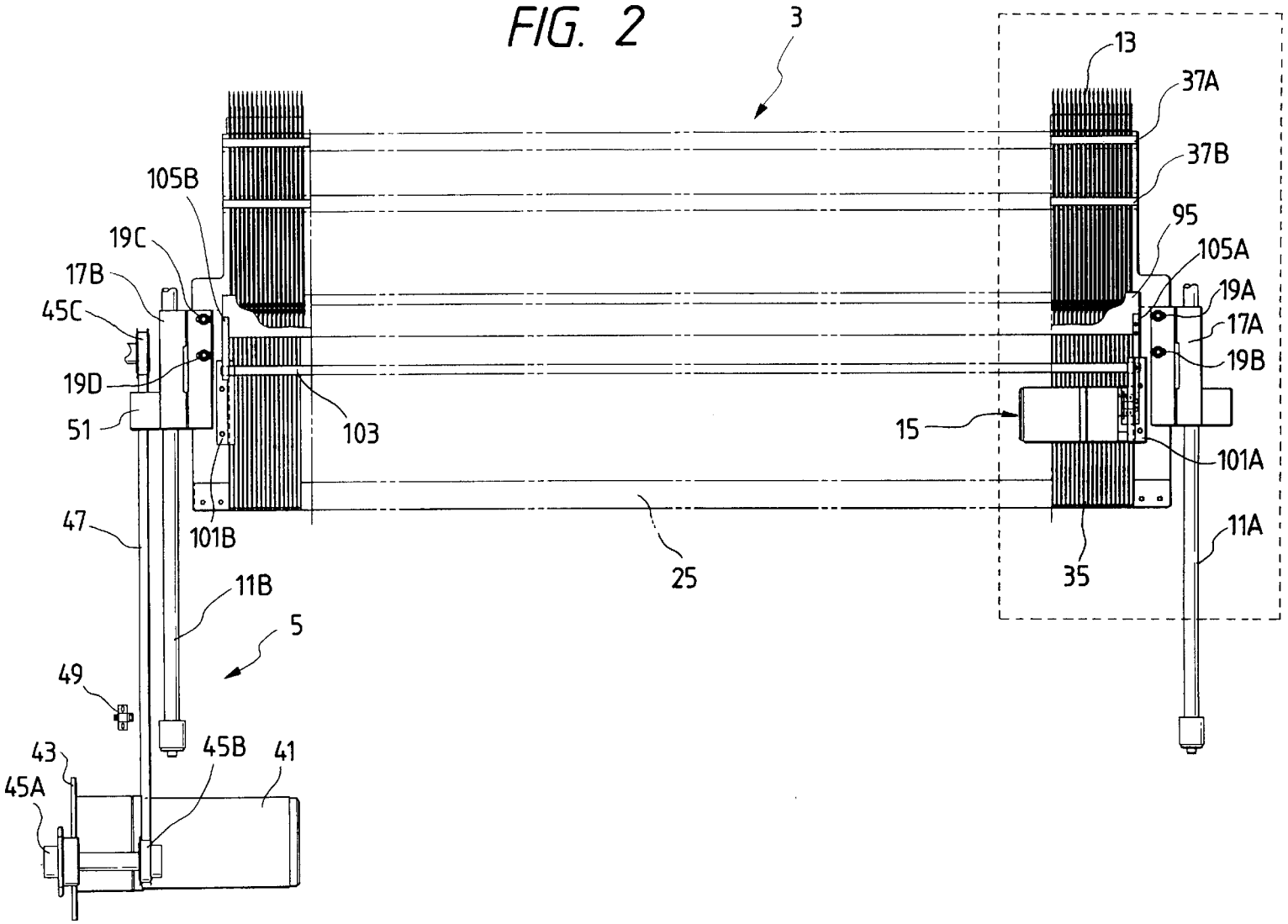
FIG. 2 is a view of a setting-up needle bed and a lift mechanism for lifting and lowering the setting-up needle bed.

FIG. 1 is a side view of a schematic structure of a set-up device 1 for use in a flat knitting machine according to a preferred embodiment of the present invention. FIG. 2 is a front view of a setting-up needle bed 3 and a lift mechanism 5 for lifting and lowering the setting-up needle bed 3. The set-up device 1 is disposed below a gap 9 formed between a front bed 7A and a rear bed 7B on both of which a large number of knitting needles (not shown) are provided. The set-up device 1 comprises: a setting-up needle bed 3 which can be held in such a manner that it is freely slidable along a pair of guide rails 11A and 11B provided in the vertical direction at the respective side end portions of the flat knitting machine; a plurality of setting-up needles 13 slidably mounted within slide grooves formed in the setting-up needle bed 3; a setting-up needle bed lift device 5 for lifting and lowering the setting-up needle bed 3 below the gap 9 in accordance with an instruction from a control unit (not shown) of the flat knitting machine; and a setting-up needle hold and release device 15 for controlling the setting-up needles 13 to hold and release a knitted fabric.

Figure 3:
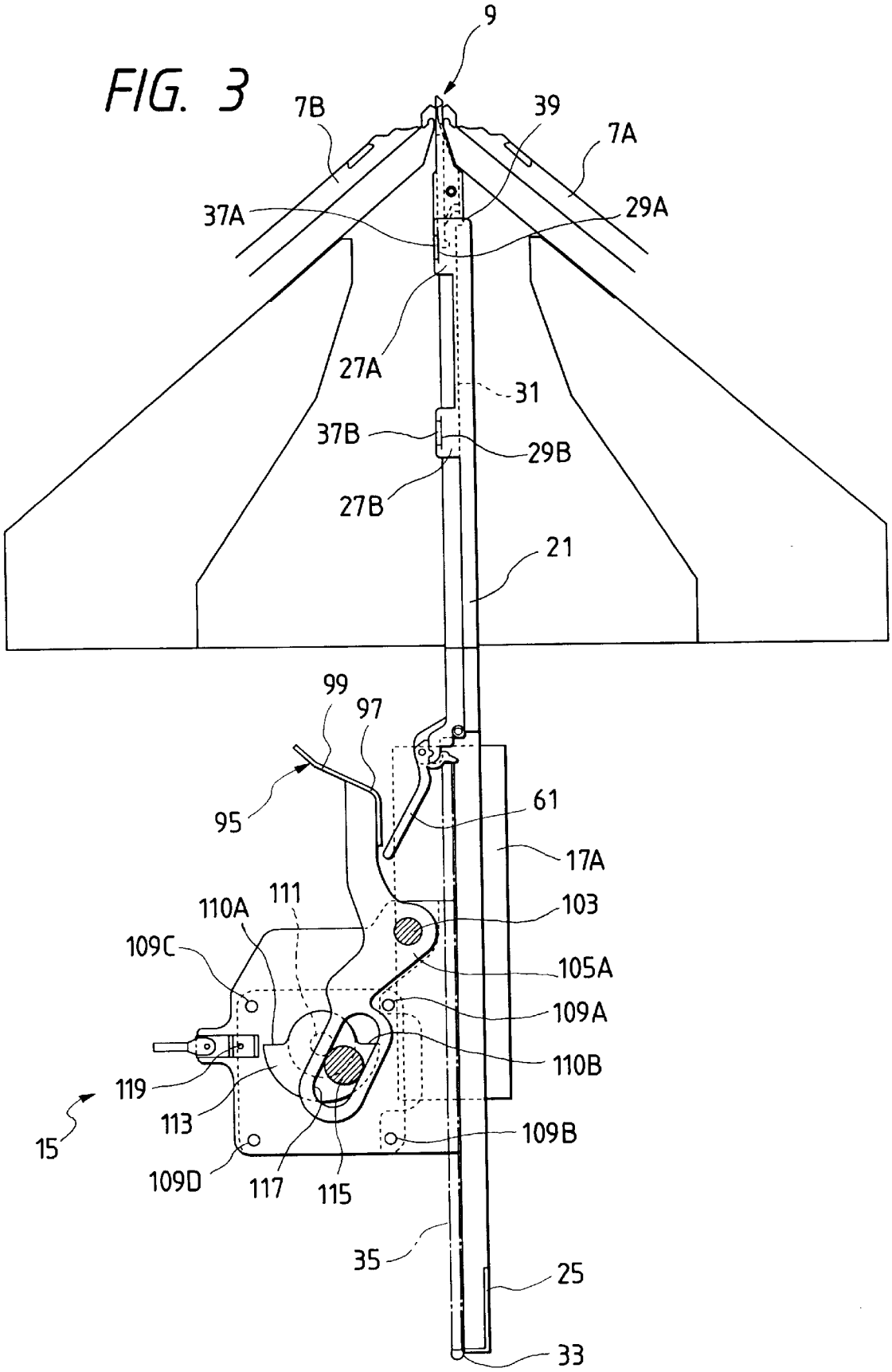
FIG. 3 is a partially enlarged view of a portion enclosed by a broken line shown in FIG. 1.
Figure 4:
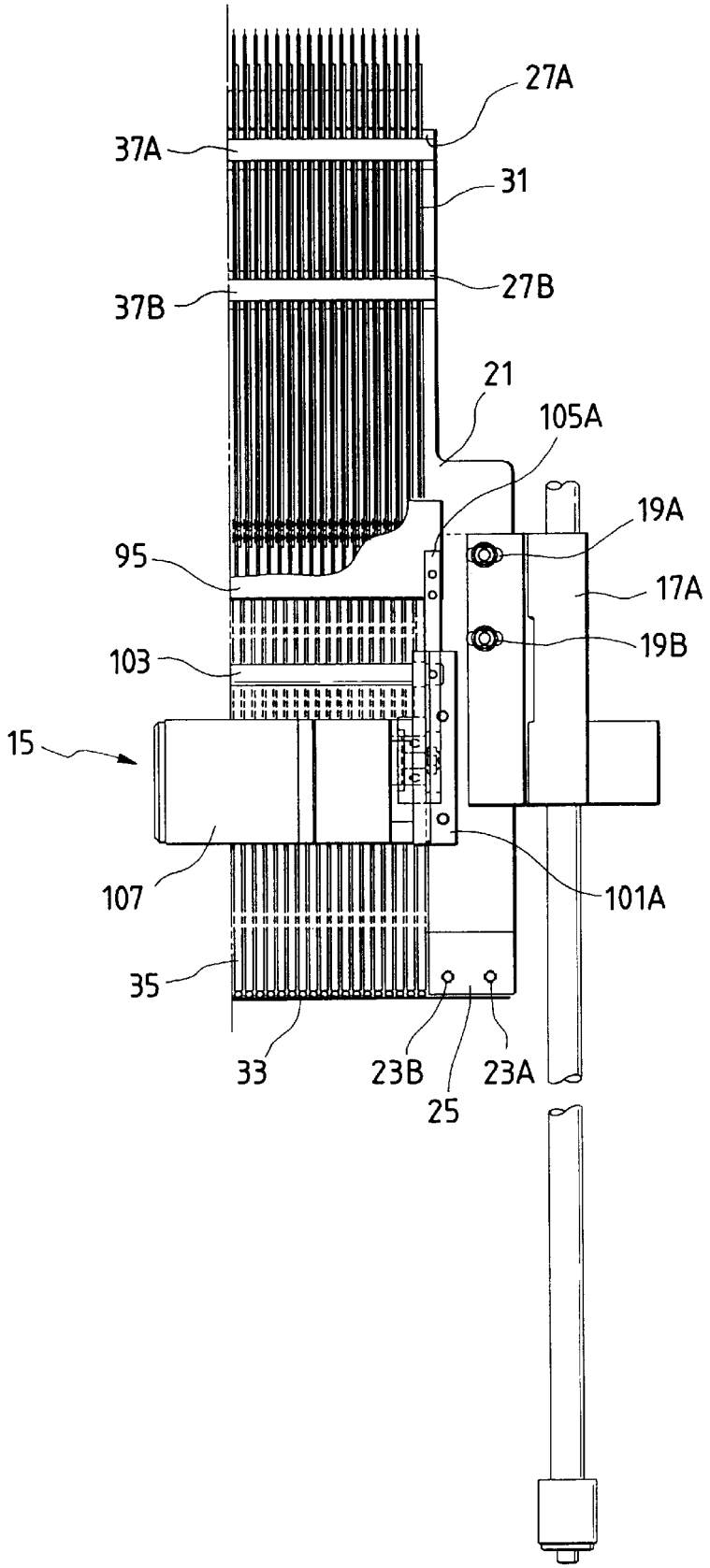
FIG. 4 is a partially enlarged view of a portion enclosed by a broken line shown in FIG. 2.
Figure 5:
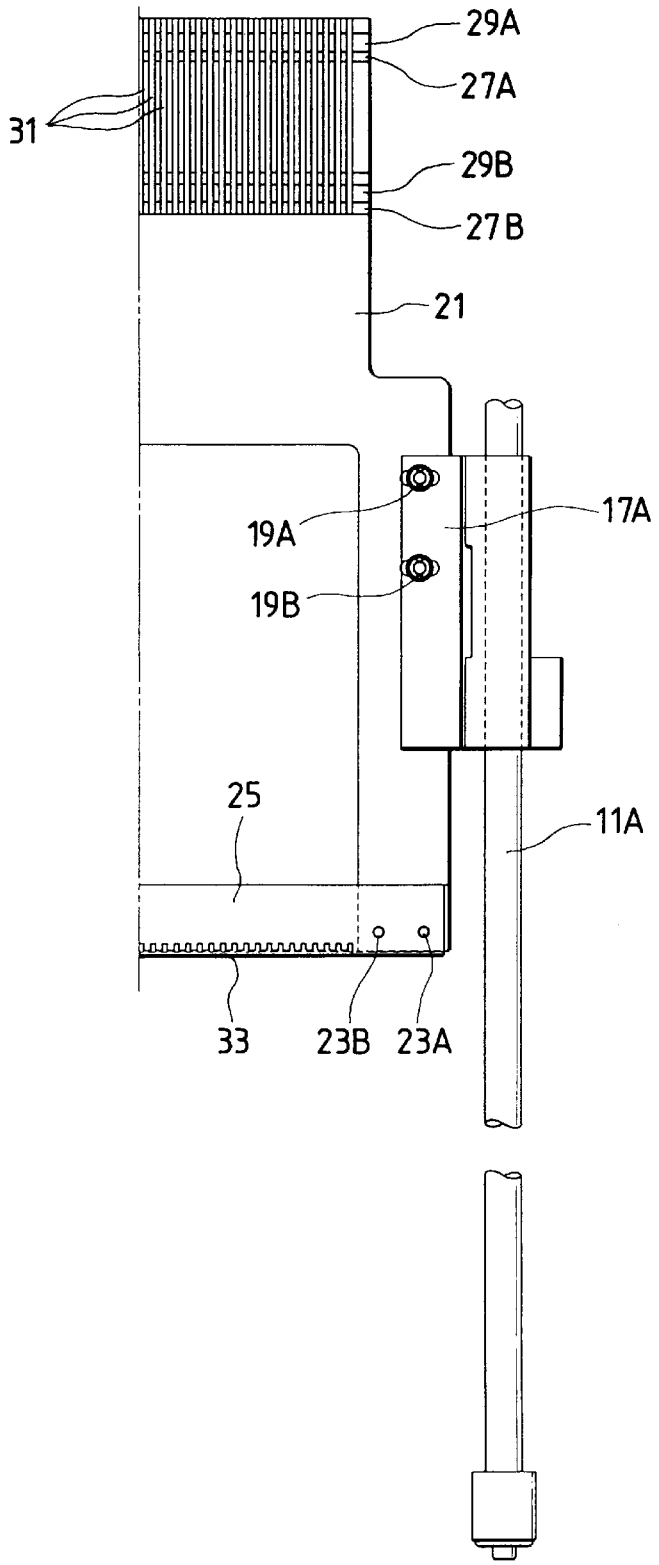
FIG. 5 is a view of a-setting-up needle bed base plate and a slide member.

The setting-up needle bed 3 is described below with reference to FIGS. 2 to 5. FIG. 3 is an enlarged view of a portion enclosed by a broken line shown in FIG. 1. FIG. 4 is a partially enlarged view of a portion enclosed by a broken line shown in FIG. 2. FIG. 5 is a view of a setting-up needle bed base plate described below. The setting-up needle bed 3 includes: a setting-up needle bed base plate 21, which is provided bridgingly between a pair of right and left slide members 17A and 17B slidably held along the guide rails 11A and 11B, and which is fixed integrally by the slide members 17A, 17B and screws 19A, 19B, 19C, 19D; and a guide member 25 which is disposed in the lower end portion of the setting-up needle bed base plate 21 with being fixed thereto by means of screws 23A and 23B. The setting-up needle bed base plate 21 includes, on the front side thereof, a pair of upper and lower belt-shaped projecting portions 27A and 27B respectively formed along the longitudinal direction of the setting-up needle bed base plate 21, and a pair of dovetail fitting grooves 29A and 29B respectively formed in the projecting portions 27A and 27B. In the dovetail fitting grooves 29A and 29B, there are formed slide grooves 31 for the setting-up needles 13 in a direction intersecting the longitudinal direction of the setting-up needle bed base plate 21 at right angles, so that one slide groove is present per one interval of each two knitting needles on the needle bed 7A, and the setting-up needles 13 are mounted within each the slide grooves 31. The setting-up needles 13 are inserted into the slide grooves 31 formed by the setting-up needle bed base plate 21 with the upper-and lower dovetail fitting grooves 29A and 29B, and presser plates 37A and 37B are respectively mounted on the dovetail fitting grooves 29A and 29B, whereby the setting-up needles 13 are freely slidable relative to the setting-up needle bed base plate 21 and are held in such a manner that they are prevented from falling off the slide grooves 31. By laying a coil spring 35 between each of spring suspending portions 33 formed in the guide member 25 and the respective setting-up needle 13, the setting-up needles 13 are each biased downwardly in FIG. 3. For this reason, in a state where the setting-up needle 13 does not retain the set-up portion of the knitted fabric, the projecting portions 39 of the setting-up needles 13 are engaged with the upper end of the setting-up needle bed base plate 21, so that the setting-up needles 13 are held at the lower-most position relative to the setting-up needle bed base plate 21. The setting-up needle bed 3 is connected to a timing belt 47, which is laid between a pulley 43 having drive teeth rotatable by a drive motor 41 and pulleys 45A, 45B and 45C having driven teeth, by well-known connecting means. When the drive motor 41 is driven and rotated forwardly or reversely, the setting-up needle bed 3 is driven upward or downward. On the rotary shaft of the pulley 43 with drive teeth, there is mounted an encoder (not shown) which is used to detect the position of the setting-up needle bed 3. Based on the position data that are output from the encoder, the control unit of the flat knitting machine drives and rotates the pulley 43 with drive teeth to thereby slide the setting-up needle bed 3 upward and downward. The knitted fabric is pulled down according to the progress of the knitting. In FIG. 1 and 2, reference character 49 designates a sensor for detecting the lower limit position of the setting-up needle bed 3. If the sensor 49 detects a detect piece 51 installed on the slide member 17B, then the control unit of the flat knitting machine stops the operation of the motor 41 to thereby stop the downward sliding motion of the setting-up needle bed 3.

Figure 6A:
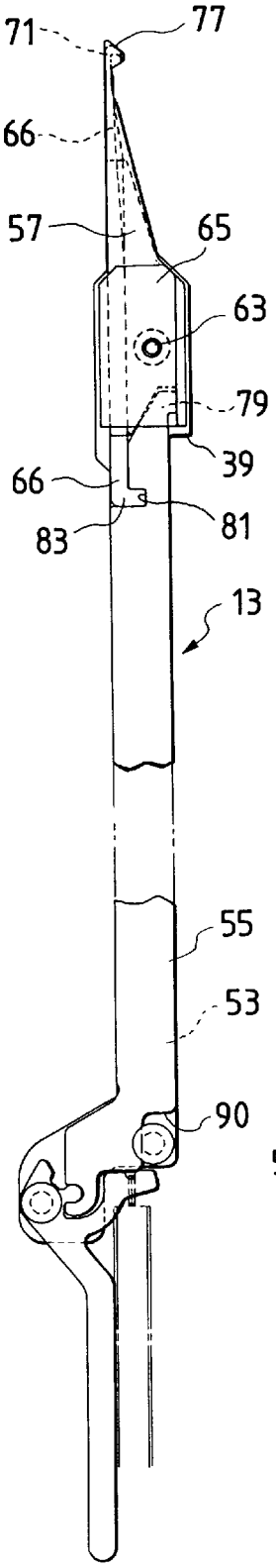
FIGS. 6A to 6C each is a view of a setting-up needle for use in the invention.
Figure 6B:
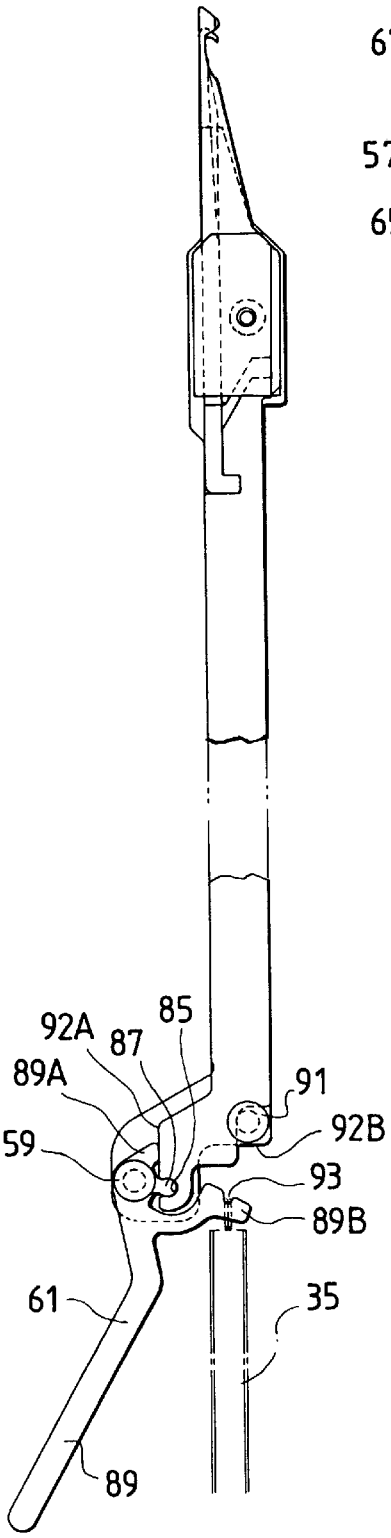
Figure 6C:
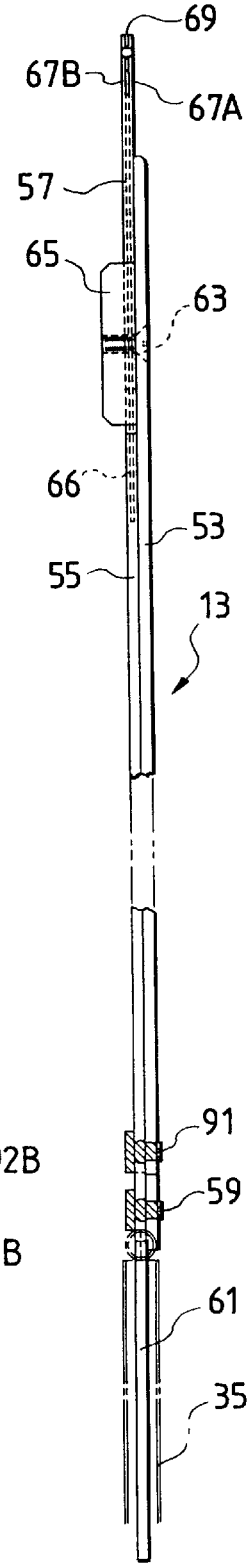
Figure 7A:
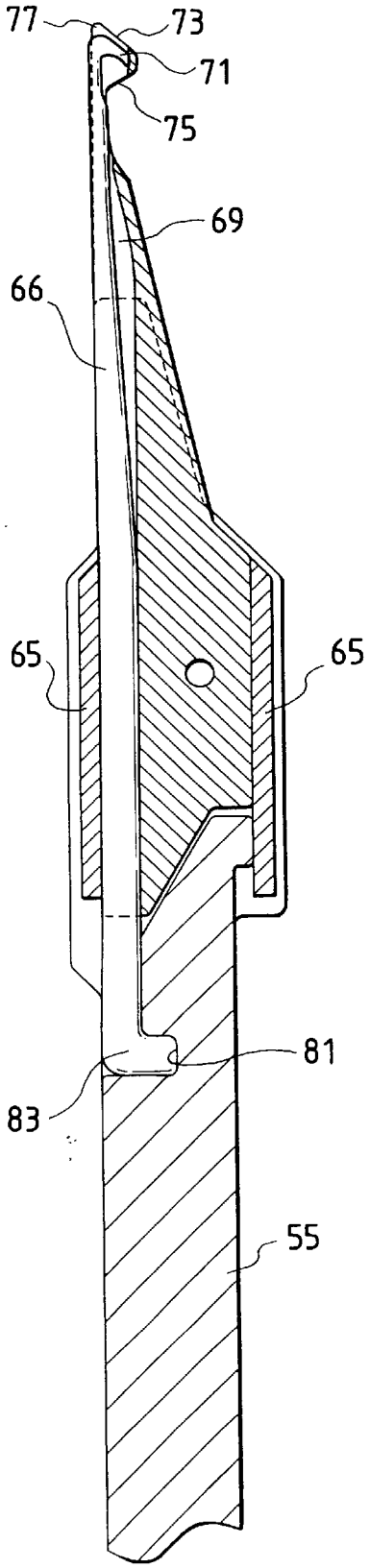
FIGS. 7A and 7B each is a section view of the leading end portion of the above setting-up needle.
Figure 7B:
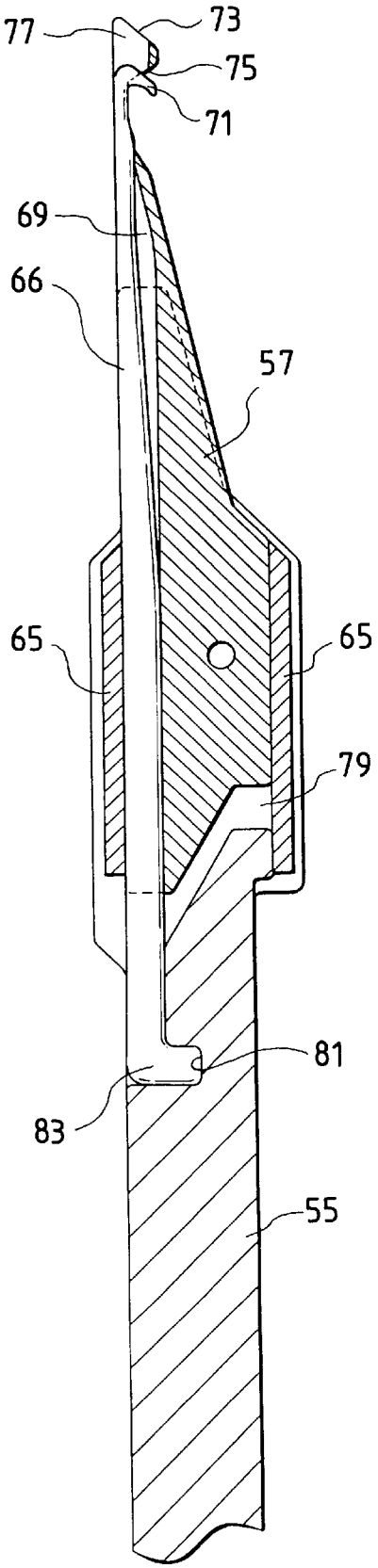
Figures 1, 10:
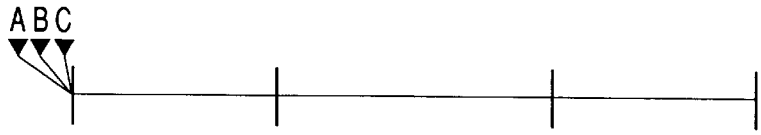
Figures 2, 10:
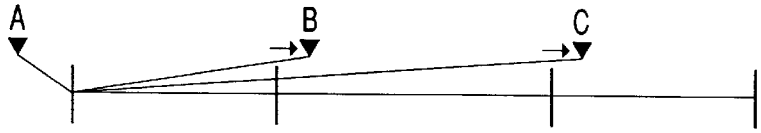
Figures 3, 10:
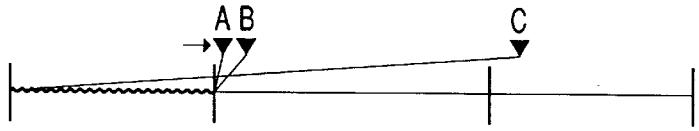
Figures 4, 10:
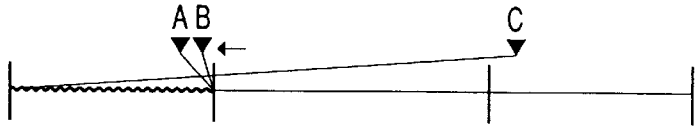
Figures 5, 10:
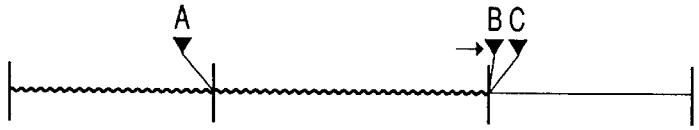
Figures 6, 10:
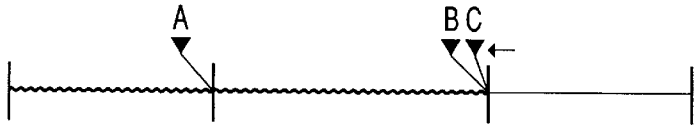
Figures 7, 10:
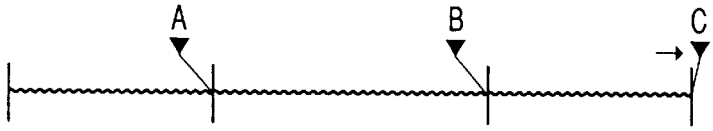
Figures 8, 10:
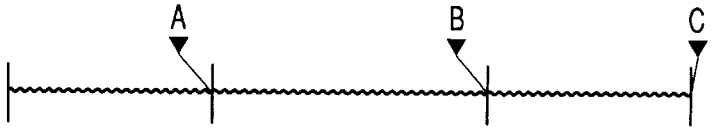

The setting-up needle 13 is explained below with reference to FIGS. 6 and 7. FIG. 6A is a side view of the setting-up needle 13, showing a state thereof when it is held in its closed state; FIG. 6B is a side view of the setting-up needle 13, showing a state thereof when it is held in its open state; and FIG. 6C is a front view thereof corresponding to FIG. 6B. FIGS. 7A and 7B are cross-sectional views of the leading end portion of the setting-up needle 13, each showing a state thereof in which it is cut at the position of the slider surface. FIG. 6A corresponds to FIG. 7A, while FIG. 6B corresponds to FIG. 7B. The setting-up needle 13 comprises a setting-up needle body 53; a slider 66; a slider control member 55 which is laminatedly disposed on the setting-up needle body 53; a setting-up needle leading end portion 57 which is held integrally with the setting-up needle body 53 in the leading-end portion thereof; and a swing lever 61 held swingably around the axis of a pin 59 which is mounted in the setting-up needle body 53. The setting-up needle leading end portion 57 is held integrally with the setting-up needle body 53 with a spacer 65 which is fixed by a screw 63 to one side surface of the setting-up needle body 53. In the setting-up needle leading end portion 57, there is formed a sliding groove 69 by a pair of side walls 67A and 67B with a slider 66 being contained therein. The slider 66 is held, in the sliding groove 69, slidable either forward and backward, and includes a hook-shaped yarn retaining portion 71 for retaining a knitting yarn. The spacer 65, which is mounted on one side surface of the setting-up needle 13, has a thickness equal to the sum of the thickness of the setting-up needle body 53 and the interval from a sliding groove 69 to the next sliding groove 69 formed on the setting-up needle bed. Therefore, when the setting-up needles 13 are inserted in the sliding grooves 69, the side face of the spacer 65 and the side face of the setting-up needle body 53 of the adjacent setting-up needle 13 are slidably in contact with each other and, even in a condition in which the setting-up needle 13 is pulled upward from the sliding groove 31 of the setting-up needle bed base plate 21, whereby the distance between the setting-up needles can be maintained constant. This enables to prevent the setting-up needle 13 from being deflected. In the setting-up needle leading end portion 57, there-is provided a storage portion 77 which is formed in an inverted triangle and includes an upwardly inclined surface 73 for storing the hook-shaped yarn retaining portion 71 of the slider 66 and a downwardly inclined surface 75. The slider control member 55 is slidably held within a space which is defined by a space 79 formed in the spacer 65 and the setting-up needle body 53. By engaging a recessed portion 81 formed in the slider control member 55 with an engaging portion 83 provided in the slider 66, the slider control member 55 is connected with the slider 66. The swing lever 61 comprises: a projection 87, which is formed in the pivotablly supported side thereof and is engageable with a recessed portion 85 formed in the slider control member 55; a long arm 89 which is formed in the other end side and is to be butted with a setting-up needle hold and release device described below; and two short arms 89A and 89B. The leading end portion of the swing lever 61 is stored in the space 79 of the spacer 65, the trailing end portion thereof is engaged with the recessed portion 85 of the slider control member 55, and a notched portion 90 formed in the slider control member 55 is engaged with a pin 91 mounted on the setting-up needle body 53. Thus, the swing lever 61 is held freely slidable relative to the setting-up needle body 53 and also is prevented from falling off. The swinging range of the swing lever 61 is limited because the two short arms 89A and 89B thereof are respectively butted against butting portions 92A and 92B which are respectively formed in the slider control member 55. When the slider control member 55 is present at a lifted position, the slider 66 stores the hook-shaped yarn retaining portion 71 into the storage portion 77 when viewed from the side face thereof and, on the other hand, when the slider control member 55 is present at a lowered position, the slider 66 makes the hook-shaped yarn retaining portion 71 projected out of the storage portion 77. By suspending the coil spring 35 between a recessed portion 93 formed in the short arm 89B and the spring suspending portion 33 of the guide member 25, the swing lever 61 is biased clockwise in FIG. 6. In a state in which the swing lever 61 of the setting-up needle 13 is not in contact with a setting-up needle hold and release device 15 described later, the slider control member 55 is retreated to the maximum retreat position and thus, as shown in FIG. 6B, there is provided an open state where the hook-shaped yarn retaining portion 71 is projected out of the storage portion 77. On the other hand, if the swing lever 61 is swung counterclockwise in FIG. 6, then the slider control member 55 is advanced to the forefront position and thus, as shown in FIG. 6A, there is provided an closed state where the hook-shaped yarn retaining portion 71 is stored within the storage portion 77.

The setting-up needle hold and release device 15 for controlling the holding and release of a knitted fabric is explained below with reference to FIGS. 1, 3 and 4. The setting-up needle hold and release device 15 has a length extending over the entire longitudinal direction of the setting-up needle bed 3 and includes a setting-up needle control plate 95 which is bent formed to have a dogleg shape when it is viewed from the side face thereof. The setting-up needle control plate 95 includes: a pressing portion 97 for pressing against the swing lever 61 of the setting-up needle 13 situated at the lower-most position; and an upwardly inclined surface 99 which is butted against the swing lever 61 lowering down relative to the setting-up needle control plate 95 to swing the swing lever 61 counterclockwise in FIG. 3, to thereby render the hook-shaped yarn retaining portion 71 of the slider 66 stored into the storage portion 77. The two ends of the setting-up needle control plate 95 are held by a pair of right and left swing arms 105A and 105B which are respectively held swingable on a fulcrum, i.e., a shaft 103 provided between mounts 101A and 101B which are respectively mounted on the setting-up needle bed base plate 21. The setting-up needle hold and release device 15 includes a drive motor 107 for driving and swinging the setting-up needle control plate 95. The drive motor 107 is fixed by screws 109A, 109B, 109C and 109D which are respectively mounted on the setting-up needle bed base plate 21. The drive motor 107 includes a rotary shaft 111 on which a fan-like cam 113 is provided, while a rotary roller 115 rotatably attached on the fan-like cam 113 is fitted into a fitting groove 117 formed in the swing arm 105A. If the drive motor 107 is driven and rotated in accordance with an instruction from the control unit of the flat knitting machine and thus the rotary roller 115 is displaced within the guide groove, then the swing lever 61 and setting-up needle control plate 95 are both swung, so that the setting-up needle control plate 95 is caused to approach or move away from the swing lever 61 of the setting-up needle 13. In FIG. 3, reference character 119 designates a sensor for detecting the two ends 111A and 110B of the fan-like cam 113 to thereby enable to detect the two positions of the setting-up needle control plate 95, i.e., one is a position where the setting-up needle control plate 95 is butted against the swing lever 61 and the other is a position where it is not butted against the swing lever 61.

Figure 8:
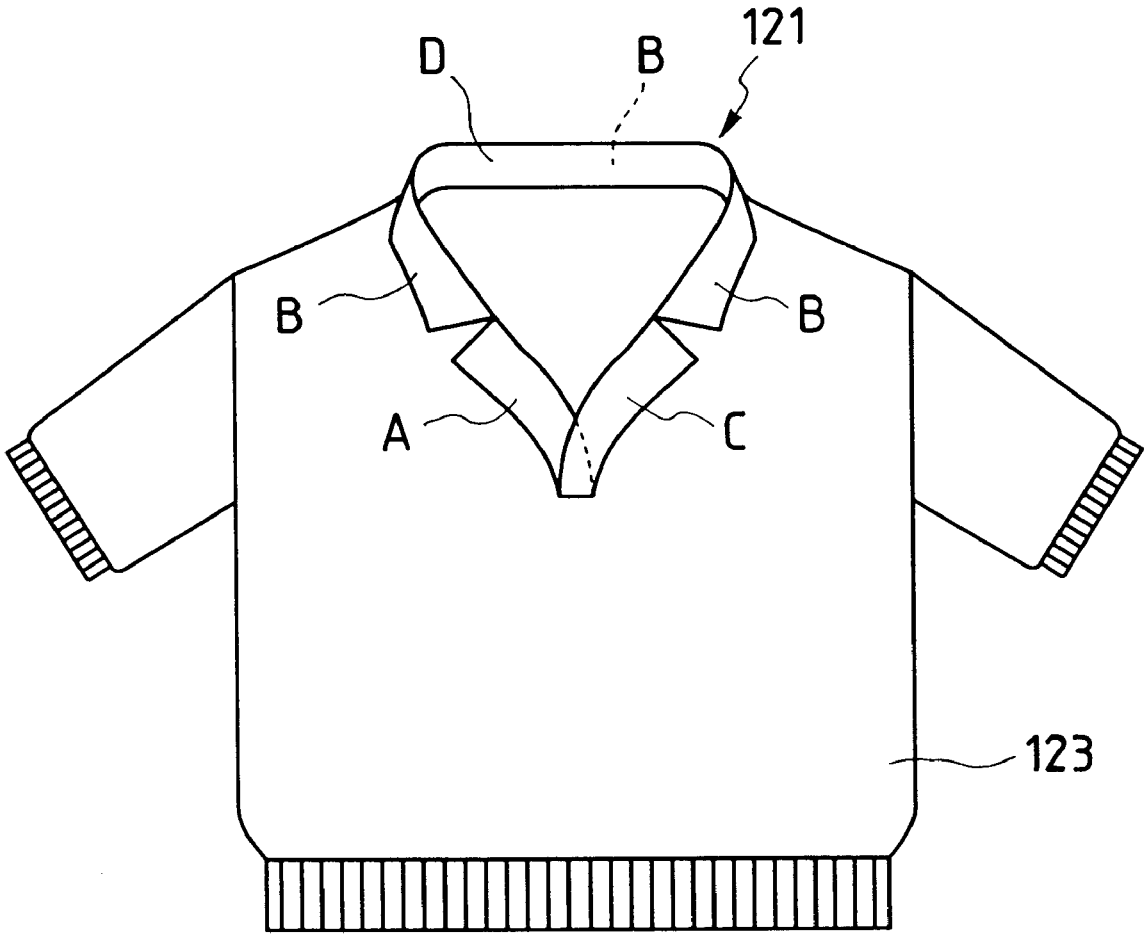
FIG. 8 is a view of a polo shirt with a wing collar sewn to the nape of the neck thereof.
Figure 9:
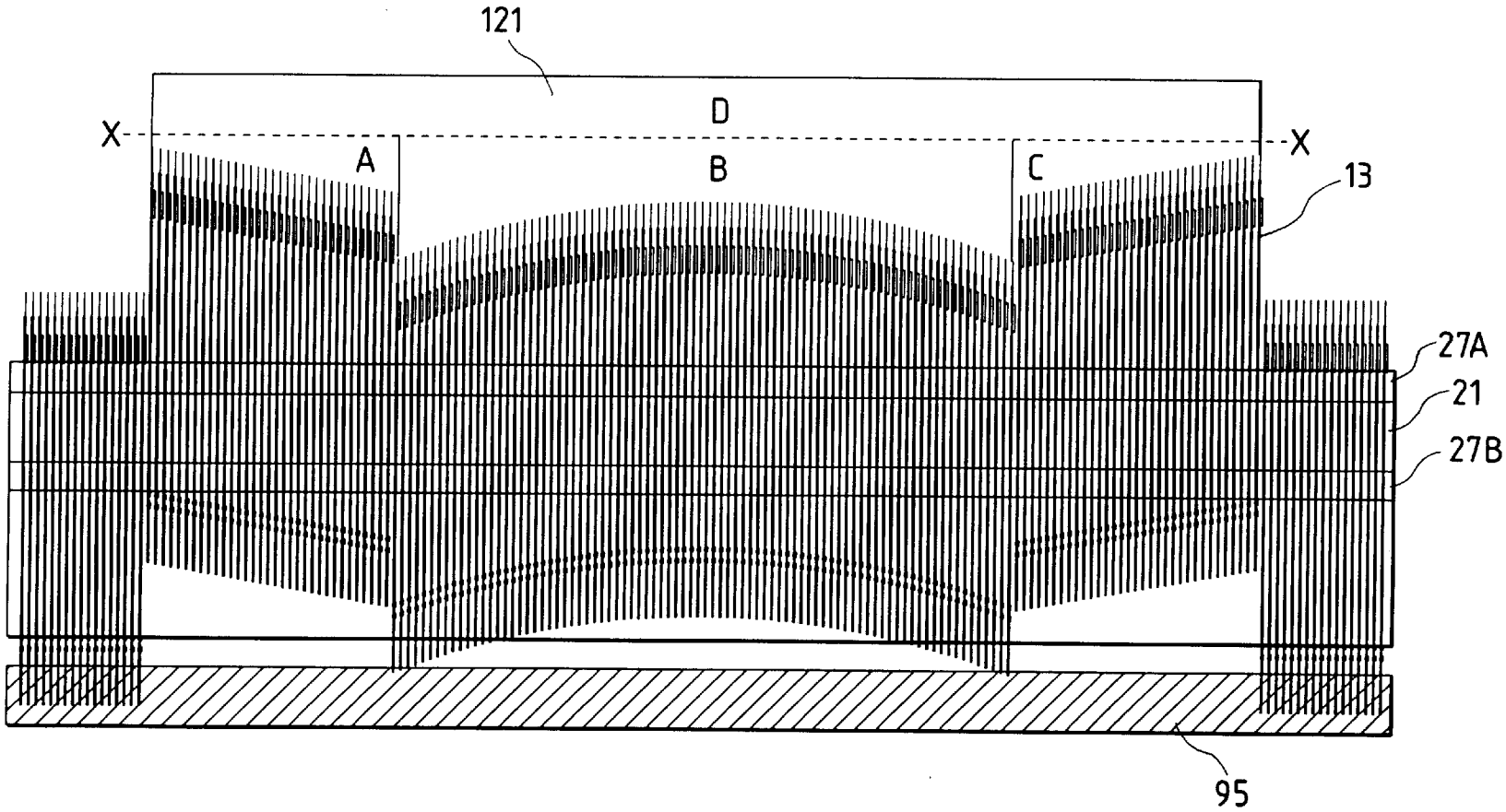
FIG. 9 is a typical view of the position relationship between a knitted fabric, setting-up needles, and a setting-up needle control plate when knitting of the fabric is completed.

An operation example of a flat knitting machine comprising the above-described setting-up device of the present invention is explained with reference to FIG. 3 and FIGS. 8 to 10. FIG. 8 is a view of a polo shirt 123, showing a state thereof in which a knitted fabric 121 referred to as "a wing collar" suitable to be knitted by the setting-up device 1 of the invention is sewn to the nape of the neck of the polo shirt 123. FIG. 9 is a typical view of the position relationship among the knitted fabric 121, setting-up needles 13 and setting-up needle control plate 95 at the time when the knitting of the fabric 121 is completed. FIG. 10 is a view of the movements of yarn feds at the time when the knitted fabric 121 shown in FIG. 9 is set up and knitted. As shown in FIG. 9, the knitted fabric 121 is composed of three parts A, B and C which are separated from each other after the knitting of the knitted fabric 121 is completed, and a part D to be knitted so that the three parts A, B and C are connected thereto. In such knitted fabric 121, the knitting is carried out upwardly from the bottom side of the knitted fabric 121 shown in FIG. 9. Below the line X—X, the parts A, B and C are knitted using individual yarn feeding ports. Thereafter, above the line X—X, the part D to be connected to each of the three parts A, B and C is knitted using a single yarn feeding port. A practical knitting process is explained below. In the flat knitting machine according to the embodiment described below, in order to eliminate the possibility that the free motion of the setting-up needles 13 is limited by a setting-up yarn supplied over between adjacently located setting-up needles 13, individual setting-up yarns are supplied to such setting-up needles in the respective areas divided according to the number of courses to be knitted, the order of knitting, and the like, to thereby carry out a set-up knitting operation. Although the set-up knitting operation is carried out using a plurality of setting-up yarns in the embodiment described below, in the flat knitting machine comprising the set-up device of the invention, it is not always necessary to carry out the set-up knitting operation using a plurality of setting-up yarns, but a plurality of setting-up yarns may be used only when the free motion of the setting-up needles is limited by the shape of a fabric to be knitted.

A practical knitting operation is explained below. At first, as shown in FIG. 10-1, a yarn feed port A used to set up and knit a part A, a yarn feed port B used to set up and knit a part B, and a yarn feed port C used to set up and knit a part C are prepared on the left of a knitting area. In FIG. 10-2, the yarn feed ports B and C are respectively moved to the respective left ends of the corresponding parts. In FIG. 10-3, a knitting yarn is supplied from the yarn feed port A to knitting needles on the needle bed in the area of the part A to carry out a set-up knitting operation. Next, in FIG. 10-4, the yarn feed ports A and B are respectively moved to the left side of the part B. At this time, the knitting yarn delivered directly to the yarn feed portion B from the end of the knitting area is held by the setting-up yarn of the yarn feed port A that has been used to knit the part A, and a setting-up yarn B is lowered down to such a position that the hook of the knitting needle can catch the setting-up yarn B. Next, in FIG. 10-5, the yarn feed port B is used to set up and knit the part B. In FIG. 10-6, after the yarn feed ports B and C are moved to the left side of the part C, a setting-up yarn is supplied to the part C from the yarn feed port C in FIG. 10-7, so that the setting-up yarns are retained to the knitting needles over all the areas of the parts A, B and C. From this state, knitting operations similar to the knitting operations shown in FIG. 10-3 to FIG. 10-8 are carried out from the right side to the left side, to thereby cross the setting-up yarns supplied in FIG. 10-3 to FIG. 10-8 and the setting-up yarns supplied in the subsequent knitting operations so that the setting-up yarns are retained by the setting-up needles. As a result of this, the present set-up knitting operation can be effected. The details of the above-described set-up knitting operation are disclosed and shown in the above-described U.S. Pat. Nos. 5,097,684 and 5,040,384 to the present applicant, particularly, in FIGS. 15(*a*) to 15(*c*), and thus the detailed description thereof is omitted here.

After the set-up knitting operation is carried out according to the above method, in order that a setting-up yarns provided between the knitting needles of the front and rear needle beds 7A and 7B are retained to the setting-up needles 13, the setting-up needle bed 3 is lifted up. The drive motor 41 is driven and rotated in accordance with an instruction from the control unit of the flat knitting machine, so that the setting-up needle bed 3 moves upward through the timing belt 47 and driven pulley 45. In this case, as shown in FIG. 3, the setting-up needle control plate 95 of the setting-up needle hold and release device 15 is held at a position where it is not butted against the lever 61 of the setting-up needle 13, while the setting-up needle 13 is situated by the coil spring 35 at the lower-most position relative to the setting-up needle bed base plate 21. In the setting-up needle 13, the slider control member 55 is retreated relative to the setting-up needle body 53 by the action of the coil spring 35, while the slider 66 connected to the slider control member 55 is held in a condition that the hook-shaped yarn retaining portion 71 is projected out from the storage portion 77 of the setting-up needle leading end portion 57. The setting-up needle bed 3, which is capable of moving upward by the drive motor 41, is lifted up to a height position where the hook-shaped yarn retaining portion 71 of the setting-up needle 13 exceeds the described setting-up yarns. In this state, the setting-up yarns provided between the knitting needles of the front and rear needle beds 7A and 7B are butted against the setting-up needles 13. However, the setting-up yarns are guided by the upwardly inclined surface 73 of the setting-up needle leading end portion 57, moved beyond the hook-shaped yarn retaining portion 71 of the slider 66, and is then retained to the hook-shaped yarn retaining portion 71 of the slider 66. After such retaining of the setting-up yarn is completed, the drive motor 41 is driven reversely to thereby lower down the setting-up needle bed 3. As shown in FIG. 9, when a knitted fabric having the number of knitted courses different from wale to wale is produced, the-setting-up needles 13 in the part B including a large number of knitted courses are situated at low positions relative to the setting-up needle bed base plate 21, whereas the setting-up needles 13 in the parts A and C each including a small number of knitted courses are situated at high positions relative to the setting-up needle bed base plate 21. Thus, in the set-up device 1 according to the present embodiment, the setting-up needles 13 are each moved independently depending on the number of knitted courses in the respective wales, against the biasing force of the biasing means which biases the respective setting-up needles in the pull-down direction of the knitted fabric. Therefore, it is hard to incur a problem that the pull-down tension can be excessively large or small due to the difference between the numbers of knitted courses in the respective wales as in the conventional set-up devices. This enables the application of an appropriate pull-down tension all over the knitted areas depending on the number of knitted courses.

Figure 11:
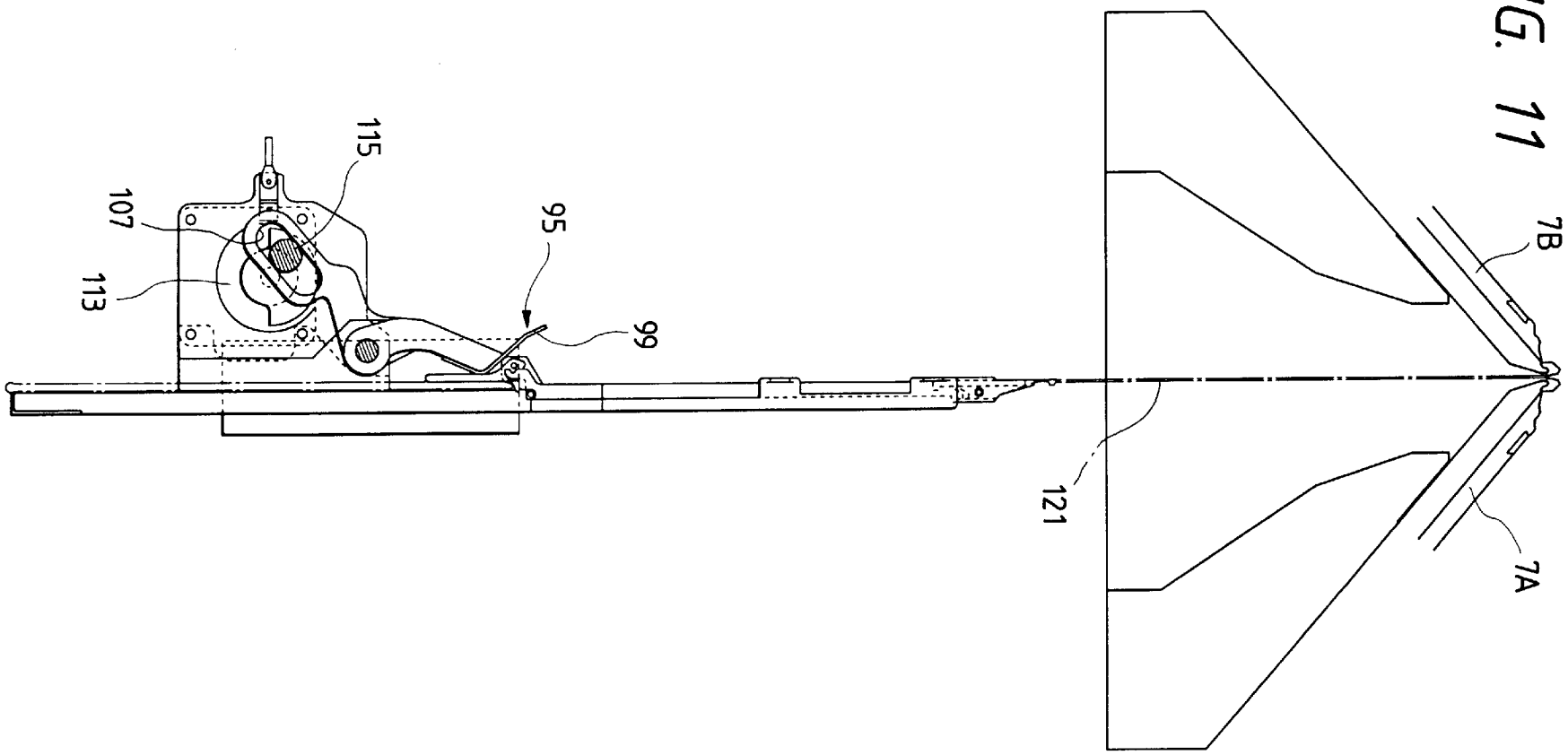
FIG. 11 a side view of a set-up device when knitting of the fabric is completed.

Next, a manner to release the setting-up yarn from the setting-up needles 13 after completion of the knitting of the fabric is explained below with reference to FIGS. 9 and 11. FIG. 11 is a side view of the set-up device 1 when the knitting of the fabric 121 is completed. In knitting the fabric 121 in which the number of knitted courses is different in the respective wales, at a time when the knitting of the fabric 121 is completed, as shown in FIG. 9, the setting-up needles 13 with the knitting yarn retained thereto are situated at height positions which are different in the fabric pull-down direction depending on the number of knitted courses therefor, whereas the setting needles 13, to which the setting-up yarn is not retained and which has not been used in the knitting, are situated at the lower-most position by means of the coil spring 35. In order to release the setting-up yarn from the setting-up needles 13 having the setting-up yarn retained thereto, at first, the drive motor 107 of the setting-up needle hold and release device 15 is rotationally driven, to thereby swing the setting-up needle control plate 95 to a position where it can be butted against the swing levers 61 of the setting-up needles 13. At this time, the swing levers 61 of the setting-up needles 13, which does not retain the setting-up yarn and has not been used in the knitting, are butted against the pressing portion 97 of the setting-up needle control plate 95 and, as shown in FIG. 11, they are rotated counterclockwise. As a result of this, the hook-shaped yarn retaining portions 71 of the setting-up needles 13 not retaining the setting-up yarn are stored into the storage portions 77 of the setting-up needle end portions 57. Next, in order to release the setting-up yarn from the setting-up needles 13 situated at high positions relative to the setting-up needle bed base plate 21, the setting-up needle bed 3 is moved upward. By the movement, the upwardly inclined surface 99 of the setting-up needle control plate 95 having a dogleg bent shape is butted against the swing levers of the setting-up needles situated at high positions relative to the setting-up needle bed, to thereby rotate the swing levers 61 clockwise, so that the hook-shaped yarn retaining portions 71 of the sliders 66 are stored into the storage portions 77. Since the hook-shaped yarn retaining portions 71 are stored into the storage portions 77, the setting-up yarn retained to the hook-shaped yarn retaining portions 71 is pushed out from the hook-shaped yarn retaining portions 71 by the downwardly inclined surfaces 75 of the storage portions 77 and thus is released. If the upward movement of the setting-up needle bed 3 in releasing the knitted fabric is conducted over the range which corresponds to the moving stroke of the setting-up needle 13 relative to the setting-up needle bed base plate 21, the setting-up needle control plate 95 can be contacted with the swing levers 61 of all the setting-up needles 13 and thus the setting-up yarn can be surely released from all the setting-up needles 13. Thus, the set-up device according to the present embodiment can hold and release the knitted fabric without any limitation regardless of the shape or the like of the fabric to be knitted, even if the individual setting-up needles are designed to be independently movable to cope with the case in which the number of knitted courses varies from wale to wale.

In the above-described embodiment, the setting-up needle hold and release device 15 is provided on the setting-up needle bed 3. However, this is not essential and, for example, the setting-up needle control plate 95 can also be fixed externally of the setting-up needle bed 13 with further extending it in the knitted fabric pull-down direction so as to be able to operate all over the moving areas of the setting-up needle bed 13. In this case, there is eliminated the need to lift up the setting-up needle bed 13 when releasing the knitted fabric. Also, in the above-described embodiment, description has been given of a case where the single coil spring 35 serves as not only the biasing means for biasing the setting-up needles 13 in the pull-down direction relative to the setting-up needle bed base plate 21, but also serves as the biasing means for biasing the setting-up needles 13 in the direction where the hook-shaped yarn retaining portions 71 of the sliders 66 are projected. Alternatively, these biasing means can also be provided separately. Further, in the above-described embodiment, description has been given of an example where the set-up portion of the knitted fabric is formed of the setting yarn. However, according to the invention, the formation of the knitted fabric set-up portion is not limited to the method employed in the illustrated embodiment using the setting-up yarn. Still further, in the above-described embodiment, the setting-up needle leading end portion 57 is fixed to the setting-up needle body 53, and the slider 66 having the hook-shaped portion yarn retaining portion 71 is designed as freely slidable. However, on the contrary, the hook-shaped portion yarn retaining portion 71 may be fixed to the setting-up needle body 53, and the setting-up needle leading end portion 57 into which the hook-shaped portion yarn retaining portion 71 can be stored may be designed as freely slidable. Yet further, in the above-described embodiment, the setting-up needles 13 are biased in the knitted fabric pull-down direction by the coil spring. However, the biasing means for biasing the setting-up needles 13 is not limited to the coil spring that is used in the above-described embodiment. For example, a spiral spring can be used. In addition, as a biasing means other than a spring, it is also possible to use a weight, an air cylinder, an oil cylinder or the like. Moreover, in the above-described embodiment, the setting-up needle bed is moved upward for releasing the knitted fabric after swinging the setting-up needle control plate to the position where it contacts the swing levers of the setting-up needles. Alternatively, the release of the knitted fabric can also be effected by first lifting the setting-up needle bed followed by swinging the setting-up needle control plate.

As described above, in a flat knitting machine comprising a set-up device according to the invention, even when the number of knitted courses varies in the respective wales, an appropriate pull-down tension can be applied to the respective wales depending on the number of knitted courses. This makes it possible to produce a knitted fabric which has been difficult to be realized in the conventional knitting machine. Also, there is eliminated the problem that the knitting yarn of the set-up portion of a knitted fabric is cut due to the unbalanced pull-down tension. And, even if the individual setting-up needles are designed as independently movable, the knitted fabric can be released freely from the setting-up needles.

Further, in case that the biasing means for biasing the setting-up needles in the pull-down direction relative to the setting-up needle bed base member and the biasing means for biasing the setting-up needles 13 in a direction to permit it to hold the knitted fabric are designed as a single biasing means, the constitution of the set-up device can be simplified.

Still further, when each of the setting-up needles is designed to have, on the side surface thereof, a spacer having a thickness so as to contact its adjacent setting-up needle, the leading end portion of the present setting-up needle can be guided by the spacer of the adjacent setting-up needle, to thereby eliminate the need to provide the setting-up needle bed all over the movable areas of the setting-up needles. Thus, the setting-up needle bed can be made compact.

While the invention has been described in detail and with reference to specific examples thereof, it will be apparent to one skilled in the art that various changes and modifications can be made therein without departing from the spirit and scope thereof.

What is claimed is:

1. A flat knitting machine comprising:

at least a pair of front and rear needle beds defining a gap therebetween; and a set-up device disposed below said gap, said set-up device including:

a plurality of setting-up needles, each having a setting-up needle base member and a setting-up needle slider member, said setting-up needle slider member being movable relative to said setting-up needle base member to selectively hold and release a set-up portion of a knitted fabric;

a setting-up needle bed supporting said plurality of setting-up needles so that said plurality of setting-up needles are juxtaposed to one another and that each of said setting-up needles is movable in both a fabric pull-down direction and a direction opposite thereto;

first biasing means for biasing each of said setting-up needles in said fabric pull-down direction relative to said setting-up needle bed; and setting-up needle hold and release means for moving said setting-up needle slider member relative to said setting-up needle base member to thereby control said setting-up needle slider member to hold and release said set-up portion of said knitted fabric.

2. The flat knitting-machine according to claim 1, wherein said setting-up needle hold and release means comprises:

second biasing means for biasing said setting-up needle slider member to permit said setting-up needle to hold said set-up portion of said knitted fabric; and releasing means for moving said setting-up needle slider member against a biasing force of said second biasing means in a direction to release said set-up portion of said knitted fabric from said setting-up needle.

3. The flat knitting machine of claim 1, wherein said setting-up needle slider member has a hook-shaped yarn retaining portion, and wherein said setting-needle base member has a storage portion for covering said hook-shaped yarn retaining portion of said setting-up needle slider member.

4. The flat knitting machine of claim 1, wherein said first biasing means functions also as second biasing means for biasing said setting-up needle slider member to permit said setting-up needle to hold said set-up portion of said knitted fabric.

5. The flat knitting machine of claim 1, wherein each of said setting-up needles has a spacer provided on one side surface thereof to contact with an adjacent setting-up needle.

6. A set-up device adapted to be used for a flat knitting machine, said set-up device comprising;

a plurality of setting-up needles juxtaposed side by side, each including a slider for capturing a set-up portion of a fabric, and a base movably supporting said slider thereon;

a setting-up needle bed movably supporting said bases of said setting-up needles;

a first biasing means for biasing said base of said setting-up needle relative to said setting-up needle bed thereby establishing a relative position therebetween; and a second biasing means for biasing said slider of said setting-up needle relative to said base of said setting-up needle to permit said slider to capture said set-up portion of said fabric.

7. The set-up device according to claim 6, further comprising releasing means for moving said slider relative to said base against a biasing force of said second biasing means to release said set-up portion of said fabric from said slider.

8. The set-up device according to claim 6, wherein a relative position between said base of one of said setting-up needles and said setting-up needle bed is determined by said first biasing means independently from the others of said setting-up needles.

9. The set-up device according to claim 6, wherein a relative position between said base of one setting-up needle and said setting-up needle bed depends on a tension acting on said set-up portion captured by said slider of said one setting-up needle.

10. The set-up device according to claim 6, wherein said slider and said base have a hook-shaped yarn capturing portion and a storage portion, respectively, and said hook-shaped portion is projected from and retracted into said storage portion by a relative movement between said base and said slider.

11. The set-up device according to claim 6, wherein said first and second biasing means includes a common spring suspended between said base and said setting-up needle bed.

12. The set-up device according to claim 6, wherein each of said setting-up needles has a spacer slidably contacting with an adjacent setting-up needle.

* * * * *